US005309928A

United States Patent [19]

Longoria

[11] Patent Number: 5,309,928

[45] Date of Patent: May 10, 1994

[54] SPIRAL PERMANENT RODS

[76] Inventor: Irma A. Longoria, 2006 Oaklawn Dr., Conroe, Tex. 77301

[21] Appl. No.: 101,217

[22] Filed: Aug. 4, 1993

[51] Int. Cl.[5] ..... A45D 2/14

[52] U.S. Cl. ..... 132/268; 132/251; 132/253

[58] Field of Search ..... 132/245, 246, 247, 248, 132/250, 251, 252, 253, 261, 263, 268

[56] References Cited

U.S. PATENT DOCUMENTS

| | | | |
|---|---|---|---|
| 23,842 | 5/1859 | Ivins | 132/251 |
| 168,388 | 10/1875 | Gardner | 132/251 |
| 4,230,133 | 10/1980 | Aniszewski et al. | 132/253 |
| 4,249,550 | 2/1981 | Cassidy | 132/252 |
| 4,284,091 | 8/1981 | Ehmann | 132/252 |
| 4,955,401 | 9/1990 | Parsons | 132/262 |

FOREIGN PATENT DOCUMENTS

| | | | |
|---|---|---|---|
| 0107192 | 9/1927 | Austria | 132/246 |
| 0027853 | 7/1884 | Fed. Rep. of Germany | 132/245 |
| 0748313 | 7/1933 | France | 132/245 |
| 0599326 | 3/1948 | United Kingdom | 132/246 |

*Primary Examiner*—Gene Mancene
*Assistant Examiner*—Frank A. LaViola
*Attorney, Agent, or Firm*—Jesus Sanchelima

[57] ABSTRACT

A hair curler device for winding hair strands in the application of spiral permanents. Two rod members are connected at one of their respective ends to a flexible elongated connector. The rod members include trapezoidal threads that cooperatively receive hair strands of a person. Removably mounted locking pieces embrace the rod members at a position along the rod members that substantially coincides with the end of the strand of hair being treated. A rubber band urges the free ends of the rod members toward each other.

4 Claims, 1 Drawing Sheet

SPIRAL PERMANENT RODS

BACKGROUND OF THE INVENTION

1. Field of the Invention

The present invention relates to hair curler instruments for spiral permanents.

2. Description of the Related Art

Applicant believes that the closest reference corresponds to U.S. Pat. No. 4,955,401 issued to Parsons in 1990. Parsons' invention was intended to overcome the deficiencies of the prior art device, i.e. being uncomfortable and the smooth surface that permitted the hair strands to slide. To resolve this problem, a single rod 32 with radially projecting posts 34*a* and 34*b* was designed. However, it differs from the present invention because the hair strands are wound in two rods that are interconnected through a flexible connector thereby permitting a stylist to distribute the hair in two spaced apart rods kept in a spaced apart relationship with respect to each other and there are no uncomfortable rigid parts, like loop 60 and posts 32*a*; 32*b*; 34*a* and 34*b* in Parsons. Also, since several of these rods are required, the dimensions of loop 60 dictate that relatively thick hair strands be formed.

Other patents describing the closest subject matter provide for a number or more or less complicated features that fail to solve the problem in an efficient and economical way. None of these patents suggest the novel features of the present invention.

SUMMARY OF THE INVENTION

It is one of the primary objects of the present invention to provide an instrument to perform spiral type permanent procedures on a person's hair that is effective, stays in place and is not uncomfortable to wear for relatively long periods of time.

It is another object of the present invention to provide an instrument that can be readily used without requiring a great deal of skill on the part of the user.

It is still another object of this invention to provide a device that can be readily cleaned and disinfected by submerging it in boiling liquids without affecting its operation.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
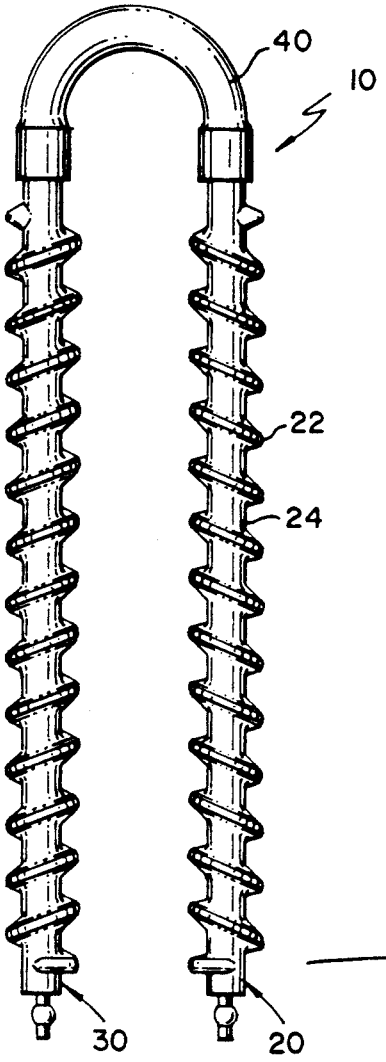
FIG. 1 represents a side elevational view of the present invention.
Figure 2:
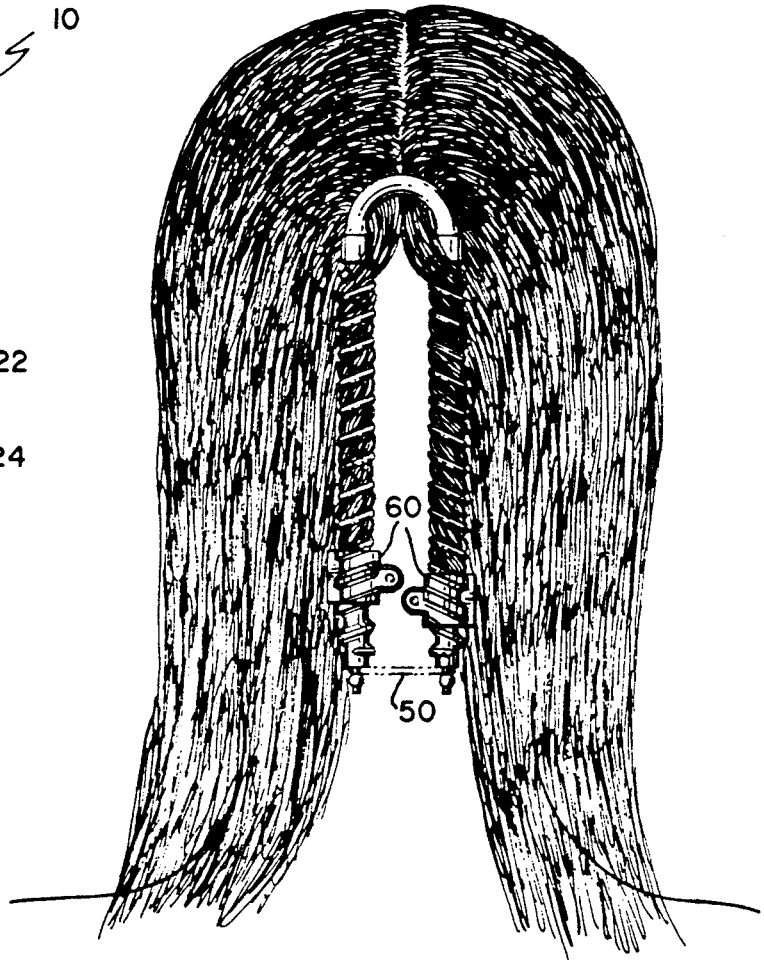
FIG. 2 shows the present invention being used on a person's hair.
Figure 3:
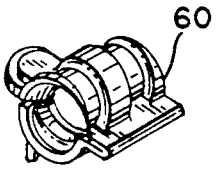
FIG. 3 illustrates a locking piece utilized to secure the end of the hair strand in place.

Referring now to the drawings, where the present invention is generally referred to with numeral 10, it can be observed that it basically includes rods 20 and 30 joined at one end by flexible connector member 40. In the preferred embodiment rods 20 and 30 are made of plastic and connector member 40 is made out of flexible plastic material.

Rods 20 and 30 include a thread of the Acme type with trapezoidal flanks 22 that are wound in opposite directions. Trapezoidal flanks 22 have a substantially flat upper surface. The hair strands wound over the valleys 24 formed by flanks 22 are consequently wound in opposite directions. In the preferred embodiment, trapezoidal flanks have been used with good results but other similar variations can also be used. In this manner, the problem of hair strands sliding down the rods, as documented in the Parsons patent, is obviated or to a great extent minimized. The diameter of rods 20 and 30 varies with the application but typically permits the winding of two strands of hair of comfortable thickness. Elastic loop 50, such as a rubber band, urges the distal ends of rods 20 and 30 towards each other once the hair strands have been wound.

Locking piece 60 is also made out of plastic and it is designed to cooperatively embrace a strand of hair around rod members 20 and/or 30 at a position that substantially coincides with the end of the hair strand.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hair curler device for winding hair strands in the application of spiral permanents, comprising:

A. a first rod member including a first thread thereon, and said first rod member having a first end and a second end;

B. a second rod member including a second thread thereon, and said second rod member having a first end and a second end;

C. elongated flexible connector means having two ends mounted to said first ends of said first and second rod members;

D. locking means for embracing said first and second rod members substantially at the ends of said hair strands; and E. elastic means for urging the second ends of said first and second rod members toward each other, and wherein said first and second threads are wound in opposite directions with respect to each other to allow hair strands to be separately wound about each of said rod members.

2. The curler device set forth in claim 1 wherein said threads include trapezoidal flanks having a substantially flat upper surface.

3. The curler device set forth in claim 2 wherein said first and second rod members, said connector means, and said locking means are made of a plastic material.

4. The curler device set forth in claim 3 wherein said elastic means includes a rubber band of cooperative dimension.

* * * * *